US010264813B2

(12) United States Patent
Benjak et al.

(10) Patent No.: US 10,264,813 B2
(45) **Date of Patent: *Apr. 23, 2019**

(54) TOBACCO TREATMENT

(71) Applicant: British American Tobacco (Investments) Limited, London (GB)

(72) Inventors: Denis Benjak, Rio De Janero (BR); Pedro Field, Rio De Janero (BR); Alcindo Glesse, Rio De Janero (BR); Matthias Link, Hamburg (DE)

(73) Assignee: British American Tobacco (Investments) Limited, London (GB)

( * ) Notice: Subject to any disclaimer, the term of this patent is extended or adjusted under 35 U.S.C. 154(b) by 55 days.

This patent is subject to a terminal disclaimer.

(21) Appl. No.: 15/033,236

(22) PCT Filed: Oct. 30, 2014

(86) PCT No.: PCT/GB2014/053223
§ 371 (c)(1),
(2) Date: Apr. 29, 2016

(87) PCT Pub. No.: WO2015/063485
PCT Pub. Date: May 7, 2015

(65) Prior Publication Data

US 2016/0270435 A1 Sep. 22, 2016

(30) Foreign Application Priority Data

Oct. 31, 2013 (GB) ..... 1319290.1

(51) Int. Cl.
*A24B 15/18* (2006.01)
*A24B 3/04* (2006.01)
(Continued)

(52) U.S. Cl.
CPC ..... *A24B 15/18* (2013.01); *A24B 3/04* (2013.01); *A24B 3/12* (2013.01); *A24B 3/18* (2013.01); *A24B 15/24* (2013.01)

(58) Field of Classification Search
CPC ..... A24B 15/18; A24B 15/24; A24B 3/04; A24B 3/12; A24B 3/18
See application file for complete search history.

(56) References Cited

U.S. PATENT DOCUMENTS 3,070,098 A 12/1962 Tempel et al.
4,343,317 A 8/1982 Bokelman
(Continued)

FOREIGN PATENT DOCUMENTS

CN 1088414 A 6/1994
CN 1133694 A 10/1996
(Continued)

OTHER PUBLICATIONS

"Fermentation", English Oxford Living Dictionaries, 2018, Oxford University Press, accessed at en.oxforddictionaries.com on Apr. 25, 2018. (Year: 2018).*
(Continued)

*Primary Examiner* — Anthony Calandra
*Assistant Examiner* — Jamel M Nelson
(74) *Attorney, Agent, or Firm* — McKee, Vorhees & Sease, PLC

(57) ABSTRACT

A process is provided for the treatment of tobacco. The process comprises securing the tobacco within a moisture-retaining material and exposing the tobacco material to an ambient processing temperature of above 55° C., with the tobacco having a packing density of at least 200 kg/m3 on a dry matter weight base at the start of the process and a moisture content of between about 10% and 23%. The treated tobacco may have desirable organoleptic properties.

23 Claims, 1 Drawing Sheet

(51) Int. Cl.

| | |
|---|---|
| ***A24B 3/12*** | (2006.01) |
| ***A24B 3/18*** | (2006.01) |
| ***A24B 15/24*** | (2006.01) |

(56) References Cited

U.S. PATENT DOCUMENTS

| | | | |
|---|---|---|---|
| 4,366,824 | A | 1/1983 | Rainer et al. |
| 4,556,073 | A | 12/1985 | Gravely et al. |
| 4,557,280 | A | 12/1985 | Gravely et al. |
| 4,917,161 | A | 4/1990 | Townend |
| 6,048,404 | A | 4/2000 | White |
| 6,202,649 | B1 | 3/2001 | Williams |
| 6,298,858 | B1 | 10/2001 | Coleman et al. |
| 7,537,013 | B2 | 5/2009 | Nelson et al. |
| 8,863,756 | B2 | 10/2014 | Andersen |
| 2005/0066986 | A1 | 3/2005 | Nestor et al. |
| 2008/0156338 | A1 | 7/2008 | Winterson et al. |
| 2012/0318287 | A1 | 12/2012 | Andersen |

FOREIGN PATENT DOCUMENTS

| | | | |
|---|---|---|---|
| CN | 2583992 | Y | 11/2003 |
| CN | 1927660 | A | 3/2006 |
| CN | 1947605 | A | 4/2007 |
| CN | 101531551 | A | 9/2009 |
| CN | 102920009 | A | 2/2013 |
| CN | 102920010 | A | 2/2013 |
| CN | 102154062 | B | 4/2013 |
| CN | 102757866 | B | 6/2014 |
| CN | 103120359 | B | 11/2014 |
| JP | 52120199 | A | 10/1977 |
| TW | 201242522 | | 11/2012 |
| WO | 2013098920 | A1 | 6/2012 |
| WO | 2013115106 | A1 | 8/2013 |

OTHER PUBLICATIONS

International Searching Authority "International Search Report and the Written Opinion" issued in connection to International Application No. PCT/GB2014/053223, 10 pages, dated Feb. 11, 2015.

Shi, et al., "Changes in TSNA Contents During Tobacco Storage and the Effect of Temperature and Nitrate Level on TSNA Formation", Coresta Agro-phyto Joint Meeting, Oct. 12-17, 2013, 32 pages.

* cited by examiner

TOBACCO TREATMENT

CROSS-REFERENCE TO RELATED APPLICATIONS

This application is the National State of International Patent Application Ser. No. PCT/GB2014/053223, filed Oct. 30, 2014, which claims priority to and benefits of Great British Patent Application Serial No. 1319290.1 filed Oct. 31, 2013, each of which is herein incorporated by reference in its entirety for all purposes.

FIELD

The present invention relates to a process and in particular a process for the treatment of tobacco.

BACKGROUND

After harvesting, tobacco material can be cured to prepare the leaf for consumption. The tobacco material may be further treated, for example by aging or fermentation, to enhance the organoleptic properties of the tobacco. However, these processes can be lengthy and the quality of the resulting tobacco material can be variable. Treatments to enhance or add flavours and aromas to the tobacco material at a later stage of tobacco processing often involve the addition of one or more additive(s) to the tobacco and can require additional processing steps and equipment, which can be costly and time-consuming.

SUMMARY

According to a first aspect of the present invention, a process is provided for the treatment of tobacco, the process comprising securing tobacco material within a moisture-retaining material and exposing the tobacco material to an ambient processing temperature of above 55° C., wherein the tobacco material has a packing density on a dry matter weight base of at least 200 kg/m$^3$ at the start of the process and has a moisture content of between about 10% and 23% before and during treatment. The process may produce a tobacco with desirable organoleptic properties.

According to a second aspect, treated tobacco material produced according to the first aspect is provided.

According to a third aspect, a smoking article or a smokeless tobacco product comprising the treated tobacco material according to the second aspect is provided.

BRIEF DESCRIPTION OF THE FIGURES

For the purposes of example only, embodiments of the invention are described below with reference to the accompanying drawings, in which.

DETAILED DESCRIPTION

Figure 1:
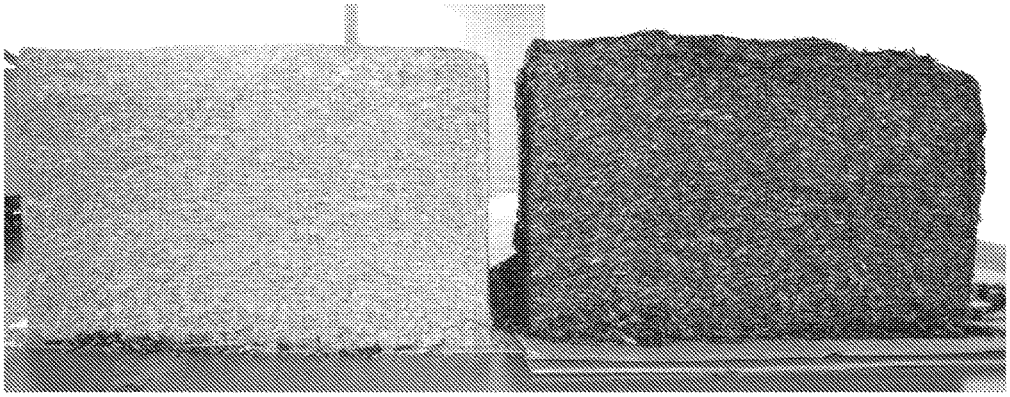
FIG. 1 shows tobacco before (left) and after (right) treatment by a process according to some embodiments of the invention.

The present invention relates to a process for the treatment of tobacco material. The treatment may enhance its organoleptic properties. As used herein, the term 'treated tobacco' refers to tobacco that has undergone the treatment process, and the term 'untreated tobacco' refers to tobacco that has not undergone the treatment process.

Tobacco undergoes a number of steps prior to consumption by the consumer. On the field the following steps are usually carried out by the farmer: seeding; transplanting; growing; harvesting; and curing.

Tobacco is generally cured after harvesting to reduce the moisture content of the tobacco, usually from around 80% to around 20% or lower. Tobacco can be cured in a number of different ways, including air-, fire-, flue- and sun-curing. During the curing period, the tobacco undergoes certain chemical changes and turns from a green colour to yellow, orange or brown. The temperature, relative humidity and packing density are carefully controlled to try to prevent houseburn and rot, which are common problems encountered during curing.

At a Green Leaf Threshing (GLT) plant the tobacco is sold by the farmer and then usually undergoes the following steps: re-grading; green-leaf blending; conditioning; stem removal by de-stemming or threshing (or not in the case of whole leaf); drying; and packing.

Usually after curing, the stem may be removed from the lamina. This may be done by threshing, in which the midribs and partially the lamina ribs are separated from the lamina by machine threshing. An alternative way to remove the stem from lamina is manually, with the so-called 'hand stripping' process. Alternatively, tobacco may be 'butted', which means that the thick part of the stem is cut, while the rest of the tobacco leaf remains integral.

In addition to curing, the tobacco may be further processed to enhance its taste and aroma. Aging and fermentation are known techniques for enhancing the taste and aroma of tobacco. These processes can be applied to tobacco materials such as threshed lamina, hand-stripped lamina, butted lamina and/or whole leaf tobacco.

Aging usually takes place after the tobacco has been cured, threshed (or butted or hand-stripped) and packed. Tobaccos that undergo aging include Oriental, flue-cured and air-cured tobaccos. During aging the tobacco might be stored generally at temperatures of around 20° C. to around 40° C. and relative humidities present at the respective country of origin/aging or under controlled warehouse conditions for around 1 to 3 years.

It is important that the moisture content of the tobacco is kept at a relatively low level during aging, for example up to around 10-13%, as mould will form in tobacco with higher moisture content.

Fermentation is a process that is applied to particular tobaccos, including dark air-cured tobacco, cured Oriental tobacco and cigar tobacco, to give the tobacco a more uniform colour and to change the aroma and taste. Fermentation is generally not applied to flue-cured and light air-cured tobacco.

The fermentation parameters, such as the moisture content of the tobacco and the ambient conditions, vary depending on the type of tobacco that is undergoing fermentation. Generally, the fermentation moisture is either similar to the moisture content of the tobacco when it has been received from the farmer (around 16-20%), or the tobacco is conditioned to a slightly higher moisture content. Care has to be taken to avoid the production of different rots, which occur when the tobacco is fermented at a moisture content that is too high. The duration of the fermentation period can vary, ranging from several weeks to several years.

Generally, fermentation involves the treatment of tobacco in large volumes and is applied to whole leaf, with subsequent removal of the stem after process. The tobacco can be arranged into large piles, which is then turned at intervals to move the tobacco at the periphery into the centre of the pile.

Alternatively, the tobacco is placed into chambers with a volume of several square meters. Treatment of such large volumes of tobacco can be cumbersome and/or time-consuming.

The density of the tobacco during fermentation is generally around 150 to 200 kg/m$^3$ (on a dry matter weight base). For comparison, the density of cut rag tobacco may be as low as 70 kg/m$^3$ and is more likely to be from about 80 to 90 kg/m$^3$.

Significantly, fermentation relies on the activity of microorganisms to effect changes in the tobacco material and the fermentation conditions, including temperature and moisture content of the tobacco, are selected to enhance the microbiological activity during fermentation. In most, if not all, cases the fermentation of tobacco relies upon microorganisms already present in the tobacco material. However, suitable microorganisms could potentially be added to the tobacco material at the start of the fermentation process.

After the above treatments, generally the tobacco is transported to other locations to be further processed, for example before it is incorporated into a tobacco-containing product. When the tobacco is being incorporated into a smoking article such as a cigarette, the tobacco is generally unpacked, conditioned, blended with other tobacco styles and/or types and/or varieties, cut, dried, blended other tobacco materials, such as dry-ice-expanded-tobacco, and handed over to the cigarette manufacturing department.

Tobacco may additionally or alternatively be treated with additives to improve or enhance the flavour and aroma of the tobacco. However, this requires additional processing steps and apparatus, making the tobacco preparation process more lengthy and often more costly. In addition, it can be desirable to have a tobacco material that has a taste and aroma that is enjoyed by consumers but has not had any additives applied to it to achieve this. This would be the case for consumers who would like a natural tobacco product that also has a pleasant flavour and/or taste, for example. Additives are generally applied in the location at which the smoking article is being produced, such as a cigarette factory, although the point at which additives are applied can vary.

In some embodiments, the process of treating tobacco material as described herein produces a tobacco material with desirable organoleptic properties within a period of time that may be shorter than the more traditional techniques such as fermentation and aging and without the addition of flavour or aromatising additives. In some embodiments, the process of the present invention involves no fermentation or essentially no fermentation. This may be demonstrated by the presence of little or no microbial content of the tobacco material at the end of the process. This is shown in Table 13 below.

In some embodiments, the process of treating tobacco material as described herein produces a tobacco with an enhanced flavour profile or enhanced organoleptic properties (compared to the flavour profile of tobacco which has not been treated or which has been treated using only conventional curing processes). This means that there is a reduction in off-notes or irritants, whilst retaining the taste characteristics of the tobacco as would be seen following conventional curing. As used herein, the terms "enhance" or "enhancement" are used in the context of the flavour or organoleptic properties to mean that there is an improvement or refinement in the taste or in the quality of the taste, as identified by expert smokers. This may, but does not necessarily, include a strengthening of the taste.

In some embodiments, the process of treating tobacco material as described herein produces a tobacco material wherein at least one undesirable taste or flavour characteristic has been reduced.

In some embodiments, the process described herein may be used to enhance the organoleptic properties of a tobacco starting material which has poor organoleptic (e.g. taste) properties. It has been found that at least one effect that the processing has on the tobacco material is the removal or reduction of organoleptic factors that have a negative impact on the overall organoleptic properties of the tobacco material. In some embodiments, the process may also result in the increase of positive organoleptic properties.

In some embodiments, the process of treating tobacco material may be adjusted to produce a treated material with particular selected organoleptic characteristics. This may, for example, involve the adjustment of one or more of the parameters of the process.

In some embodiments, the process of treating tobacco material as described herein transforms the flavour profile of the tobacco (compared to the flavour profile of tobacco which has not been treated or which has been treated using only conventional curing processes). This means that there is a significant change in the organoleptic properties of the tobacco following the processing, so that the taste characteristics of the tobacco are changed compared to those of the same tobacco following conventional curing. As used herein, the terms "transform" or "transformation" are used in the context of the flavour or organoleptic properties to mean that there is change from one overall taste or sensory character to another, as identified by expert smokers. This may include an improvement and/or refinement in the taste or in the quality of the taste.

In some embodiments, including those where the organoleptic properties of the tobacco starting material are transformed, the processing has the effect of not only reducing or removing organoleptic factors that have a negative effect, but also introducing or increasing organoleptic factors that have a positive effect. For example, in some embodiments, the process described herein leads to an increase in the products of the Maillard Reaction, many of which are known to contribute to desirable organoleptic properties. This is discussed in more detail in the Example below.

Reference made herein to the organoleptic properties of the tobacco material may be reference to the organoleptic properties of the tobacco material itself, for example when used orally by a consumer. Additionally or alternatively, the reference is to the organoleptic properties of smoke produced by combusting the tobacco material, or of vapour produced by heating the tobacco material. In some embodiments, the treated tobacco material affords a tobacco product including said tobacco material with desirable organoleptic properties when said product is used or consumed.

As used herein, the term 'tobacco material' includes any part and any related by-product, such as for example the leaves or stems, of any member of the genus *Nicotiana*. The tobacco material for use in the present invention is preferably from the species *Nicotiana tabacum*.

Any type, style and/or variety of tobacco may be treated. Examples of tobacco which may be used include but are not limited to Virginia, Burley, Oriental, Comum, Amarelinho and Maryland tobaccos, and blends of any of these types. The skilled person will be aware that the treatment of different types, styles and/or varieties will result in tobacco with different organoleptic properties.

The tobacco material may be pre-treated according to known practices.

The tobacco material to be treated may comprise and/or consist of post-curing tobacco. As used herein, the term 'post-curing tobacco' refers to tobacco that has been cured but has not undergone any further treatment process to alter the taste and/or aroma of the tobacco material. The post-curing tobacco may have been blended with other styles, varieties and/or types. Post-curing tobacco does not comprise or consist of cut rag tobacco.

Alternatively or in addition, the tobacco material to be treated may comprise and/or consist of tobacco that has been processed to a stage that takes place at a Green Leaf Threshing (GLT) plant. This may comprise tobacco that has been re-graded, green-leaf blended, conditioned, de-stemmed or threshed (or not in the case of whole leaf), dried and/or packed.

In some embodiments, the tobacco material comprises lamina tobacco material. The tobacco may comprise between about 70% and 100% lamina material.

The tobacco material may comprise up to 50%, up to 60%, up to 70%, up to 80%, up to 90%, or up to 100% lamina tobacco material. In some embodiments, the tobacco material comprises up to 100% lamina tobacco material. In other words, the tobacco material may comprise substantially entirely or entirely lamina tobacco material.

Alternatively or in addition, the tobacco material may comprise at least 50%, at least 60%, at least 70%, at least 80%, at least 90%, or at least 95% lamina tobacco material.

When the tobacco material comprises lamina tobacco material, the lamina may be in whole leaf form. In some embodiments, the tobacco material comprises cured whole leaf tobacco. In some embodiments, the tobacco material substantially comprises cured whole leaf tobacco. In some embodiments, the tobacco material consists essentially of cured whole leaf tobacco. In some embodiments, the tobacco material does not comprise cut rag tobacco.

In some embodiments, the tobacco material comprises stem tobacco material. The tobacco may comprise between about 90% and 100% stem material.

The tobacco material may comprise up to 50%, up to 60%, up to 70%, up to 80%, up to 90%, or up to 100% stem tobacco material. In some embodiments, the tobacco material comprises up to 100% stem tobacco material. In other words, the tobacco material may comprise substantially entirely or entirely stem tobacco material.

Alternatively or in addition, the tobacco material may comprise at least 50%, at least 60%, at least 70%, at least 80%, at least 90%, or at least 95% stem tobacco material.

The moisture content of the tobacco material before and during treatment is between about 10% and about 23%. As used herein, the term 'moisture content' refers to the percentage of oven volatiles present in the tobacco material.

In some embodiments, the moisture content of the tobacco is between about 10% and 15.5%, optionally between about 11% and 15% or between about 12% and 14%. The moisture content of the tobacco may be about 10%, about 11%, about 12%, about 13%, about 14%, about 15%, about 16%, about 17%, about 18%, about 19%, about 20%, about 21%, about 22% or about 23%.

In some embodiments, for example when the moisture content of the tobacco is between about 10% and 20%, optionally between about 10% and 18%, it is not necessary to redry the tobacco following the treatment process.

The tobacco material is secured within a moisture-retaining material, to limit moisture losses and to retain a desired level of moisture during the process.

The tobacco may be completely sealed within the moisture-retaining material. Alternatively, the tobacco material may not be completely sealed within the moisture-retaining material. In some embodiments, a moisture-retaining material is wrapped around the tobacco material. In some embodiments, the tobacco material is placed within a moisture-retaining container.

The moisture-retaining material may be any material that is sufficiently impermeable to moisture to retain the desired amount of moisture during the treatment process. The amount of moisture that is retained in the tobacco material may be at least 70%, at least 75%, at least 80%, at least 85%, at least 90%, at least 91%, at least 92%, at least 93%, at least 94%, at least 95%, at least 96%, at least 97%, at least 98%, at least 99%, at least 99.5% or 100% of the moisture which was present in the tobacco material prior to treatment. In some embodiments, between 99% and 100% of the moisture content of the tobacco material is retained during the process.

It is desirable for the moisture-retaining material to be resistant to degradation during the tobacco treatment process. For example, it is desirable for the moisture-retaining material to withstand the temperatures of the treatment process, without breaking down to become moisture-permeable or to release compounds that may be taken up by the tobacco material. The temperature reached by the tobacco material during the process may therefore be taken into consideration when selecting the moisture-retaining material.

The moisture-retaining material may comprise a flexible material. This flexible material may be wrapped around the tobacco material and/or formed into a pouch into which the tobacco is placed. In some embodiments, the moisture-retaining material comprises plastic material. In some embodiments, the moisture-retaining material comprises flexible polymeric material, optionally a polymeric or plastic film. In some embodiments, the moisture-retaining material comprises polyethylene. In some embodiments, the moisture-retaining material comprises polyesters, nylon and/or polypropylene. In some embodiments, the moisture-retaining material is Polyliner®. Polyliner® is available through a number of suppliers, including Plastrela Flexible Packaging, located in Brazil.

Alternatively or in addition, the moisture-retaining material may comprise a rigid material, such as metal for example, which is formed into a vessel or container. In these embodiments, a separate storage container as discussed below may not be required.

In embodiments where the tobacco material reaches a temperature of about 100° C. or above, the moisture-retaining material may be pressure-resistant.

At the start of the process, the tobacco material has a packing density of at least 200 kg/m$^3$ (on a dry matter weight base). Additionally or alternatively, at the start of the process, the tobacco material may have a packing density up to about 500 kg/m$^3$ (on a dry matter weight base). The tobacco material may have a packing density of between about 200 kg/m$^3$ and 330 kg/m$^3$, optionally between about 220 kg/m$^3$ and 330 kg/m$^3$. In some embodiments, the tobacco material has a packing density of between about 260 kg/m$^3$ and 300 kg/m$^3$, a packing density of about 200 to about 400 kg/m$^3$, or a packing density of about 250 to about 300 kg/m$^3$.

The packing density of the tobacco material may be at least 210 kg/m$^3$, at least 220 kg/m$^3$, at least 230 kg/m$^3$, at least 240 kg/m$^3$, at least 250 kg/m$^3$, at least 260 kg/m$^3$, at least 270 kg/m$^3$, at least 280 kg/m$^3$, at least 290 kg/m$^3$, at least 300 kg/m$^3$, at least 310 kg/m$^3$, at least 320 kg/m$^3$ or at least 330 kg/m$^3$.

Alternatively or in addition, the packing density of the tobacco material may be up to 220 kg/m$^3$, up to 230 kg/m$^3$, up to 240 kg/m$^3$, up to 250 kg/m$^3$, up to 260 kg/m$^3$, up to 270 kg/m$^3$, up to 280 kg/m$^3$, up to 290 kg/m$^3$, up to 300 kg/m$^3$, up to 310 kg/m$^3$, up to 320 kg/m$^3$ or up to 330 kg/m$^3$.

The packing density of the tobacco material during and/or following treatment may be similar or substantially similar to the packing density of the tobacco material at the start of the process.

The tobacco material may be placed in a storage container after it has been secured within a moisture-retaining material. Placing the secured tobacco in a container enables the tobacco to be handled easily.

The volume of the storage container may be selected to achieve the desired packing density for the desired amount of tobacco to be treated, and at the same time allows the treatment of the tobacco to take place at a suitable rate. Alternatively or in addition, the container may be oriented on its side. This arrangement may be particularly beneficial when the tobacco material comprises tobacco lamina that is in a horizontal position when placed in the storage container, as placing the storage container on its side achieves a more even packing density.

In some embodiments, the container has a volume of between about 0.2 m$^3$ and about 1.0 m$^3$, optionally between about 0.4 m$^3$ and about 0.8 m$^3$. In some embodiments, the container has a volume of about 0.6 m$^3$.

In some embodiments, the storage container is a case for tobacco known as a C-48 box. The C-48 box is generally made of cardboard and has dimensions of about 115×70×75 cm. A desirable packing density is achieved when 180-200 kg of tobacco with a moisture content of between about 12 and 15% is held within a C-48 box.

The tobacco may be placed in a tobacco processing area. As used herein, the term 'tobacco processing area' is the area, which can be a room or chamber, in which the treatment process is carried out. The ambient process conditions, i.e. the conditions of the tobacco processing area, may be controlled during the process. This may be achieved by placing the tobacco material secured within the moisture-retaining material into a controlled environment, such as a chamber. The tobacco material may be placed on one or more rack(s) within a chamber, to allow optimal ventilation to maintain constant ambient process conditions around the tobacco. The rack(s) may have one or more shelve(s) comprising bars with gaps between the bars and/or other apertures, to assist in the maintenance of constant ambient process conditions around the tobacco.

The ambient processing humidity may be maintained at a level to avoid significant moisture loss from the tobacco material. As used herein, the term 'ambient processing humidity' refers to the humidity of the tobacco processing area. As used herein, the term 'ambient relative processing humidity' refers to the relative humidity of the tobacco processing area.

In some embodiments, the ambient relative processing humidity is about 65%. The ambient relative processing humidity may be at least 40%, at least 45%, at least 50%, at least 55%, at least 60%, at least 65% or at least 70%.

The ambient processing temperature may be maintained at above 55° C., optionally at about 60° C. As used herein, the term 'ambient processing temperature' refers to the temperature of the tobacco processing area.

In some embodiments, the ambient processing temperature is at least 56° C., at least 57° C., at least 58° C., at least 59° C., at least 60° C., at least 61° C., at least 62° C., at least 63° C., at least 64° C., at least 65° C., at least 66° C., at least 67° C., at least 68° C., at least 69° C. or at least 70° C. In some embodiments, the ambient processing temperature is up to 60° C., up to 70° C., up to 75° C., up to 80° C., up to 85° C., up to 90° C., up to 95° C., up to 100° C., up to 105° C., up to 110° C., up to 115° C. or up to 120° C.

In embodiments in which the ambient processing temperature is about 55° C., the ambient processing humidity may be about 40-80 g water/m$^3$. In embodiments in which the ambient processing temperature is about 60° C., the ambient processing humidity may be about 50-110 g water/m$^3$. In embodiments in which the ambient processing temperature is about 70° C., the ambient processing humidity may be about 50-160 g water/m$^3$. In embodiments in which the ambient processing temperature is about 80° C., the ambient processing humidity may be about 50-230 g water/m$^3$. In embodiments in which the ambient processing temperature is about 90° C., the ambient processing humidity may be about 50-340 g water/m$^3$. In embodiments in which the ambient processing temperature is about 100° C. or higher, the ambient processing humidity may be about 50-500 g water/m$^3$.

In some embodiments, the ambient processing temperature is 60° C. and the ambient relative processing humidity is 60%.

During the process the temperature of the tobacco material reaches the ambient processing temperature. The tobacco material may reach the ambient processing temperature within a short period of time. For example, the tobacco material may reach the ambient processing temperature within 4 to 10 days, optionally within 5 to 9 days, within 7 to 9 days and/or within 4 to 7 days.

To achieve this, the amount of tobacco treated may be optimised for the heat to be transferred to the centre of the tobacco material sufficiently rapidly. The rate at which the temperature of the tobacco material rises and reaches the ambient processing temperature will be dependent upon a number of factors, including the ambient processing temperature, the density of the tobacco and the overall amount of tobacco being treated.

In some embodiments, the tobacco material reaches a temperature of above 55° C. and/or at least 60° C. within about 9 days. In some embodiments, the tobacco material reaches a temperature of above 55° C. and/or at least 60° C. within about 7 days. In some embodiments, the tobacco material reaches a temperature of above 55° C. and/or at least 60° C. within about 5 days. In such embodiments, the ambient processing temperature may be 60° C. In such embodiments, the tobacco may be treated in 200 kg batches.

In some embodiments, the temperature to which the tobacco material should be raised in order to have the desired impact on the organoleptic properties described herein is at least about 55° C. or at least about 60° C. Additionally or alternatively, the temperature to which the tobacco material should be raised may be up to about 80° C., up to about 85° C., up to about 90° C., up to about 95° C., or up to about 100° C.

In some embodiments, the beneficial effects of the processing according to the invention may be achieved within shorter processing periods by employing a higher ambient processing temperature.

The temperature of the tobacco material may rise during the treatment process, to reach a second temperature that is higher than ambient processing temperature. This may be achieved with the assistance of exothermic reactions taking place during the treatment process.

In some embodiments, the tobacco material reaches a second temperature which is above the ambient processing temperature. In some embodiments, the second temperature is at least 1° C. above the ambient processing temperature. at least 2° C., at least 3° C., at least 4° C., at least 5° C., at least 7° C., at least 10° C., at least 12° C., at least 15° C., at least 17° C. or at least 20° C. above the ambient processing temperature. In some embodiments, the tobacco material reaches a second temperature which is above the ambient processing temperature within about 7 to 13 days, and/or the second is reached within about 13 days or within about 11 days. In some embodiments, the tobacco material reaches a second temperature of at least 5° C. above the ambient processing temperature within about 11 to 13 days.

The temperature of the tobacco material may reach up to 60° C., up to 65° C., up to 70° C., up to 75° C., up to 80° C., up to 85° C., up to 90° C., up to 95° C., up to 100° C., up to 105° C., up to 110° C., up to 115° C., up to 120° C., up to 125° C., up to 130° C., up to 135° C., up to 140° C., up to 145° C. or up to 150° C. during the treatment process.

Alternatively or in addition, the temperature of the tobacco material may reach at least 60° C., at least 65° C., at least 70° C., at least 75° C., at least 80° C., at least 85° C., at least 90° C., at least 95° C., at least 100° C., at least 105° C., at least 110° C., at least 115° C., at least 120° C., at least 125° C., at least 130° C., at least 135° C., at least 140° C., at least 145° C. or at least 150° C. during the treatment process. In practice, the upper temperature may be limited by the thermal tolerance of the moisture-retaining material.

In some embodiments, the temperature of the tobacco material may reach between about 55° C. and about 90° C., between about 55° C. and about 80° C., or between 60° C. and about 70° C.

The tobacco may be secured within the moisture-retaining material for a sufficiently long period of time for the tobacco to develop the desirable organoleptic properties, and for a sufficiently short period of time to not cause unwanted delay in the tobacco supply chain.

The tobacco material is secured within the moisture-retaining material for a period of time and at an ambient processing temperature and ambient processing humidity suitable to give rise to an increase in the temperature of the tobacco to or above a threshold temperature, wherein the moisture content of the tobacco is between about 10% and 23%. In some embodiments, the threshold temperature is 55° C., 60° C. or 65° C.

In some embodiments, the tobacco is secured within the moisture-retaining material for between about 5 and 65 days, for between about 8 and 40 days, for between about 10 and 40 days, between about 15 and 40 days, between about 20 and 40 days, between about 25 and 35 days and/or between about 28 and 32 days.

More specifically, in order to achieve enhancement of the organoleptic properties of the tobacco material whilst retaining its original overall taste characteristics, the tobacco may be secured within the moisture-retaining material at an ambient processing temperature and ambient processing humidity suitable to give rise to an increase in the temperature of the tobacco to at least 55° C. with the moisture content of the tobacco being between about 10% and 23% for between about 5 and 16 days. In other embodiments, the organoleptic properties of the tobacco material are enhanced by treating the tobacco whilst secured within the moisture-retaining material under those conditions for up to 18 days. The treatment period may be between about 6 and 12 days, between about 10 to 12 days, between about 8 to 16 days or between about 8 and 10 days.

In order to achieve transformation of the organoleptic properties of the tobacco material to alter the original overall taste characteristics and to produce new taste characteristics, the tobacco may be secured within the moisture-retaining material at an ambient processing temperature and ambient processing humidity suitable to give rise to an increase in the temperature of the tobacco to at least 55° C. with the moisture content of the tobacco being between about 10% and 23% for between about 20 and 65 days. In other embodiments, the organoleptic properties of the tobacco material are transformed by treating the tobacco whilst secured within the moisture-retaining material under those conditions for at least 20 days. The treatment period may be between about 25 and 65 days, between about 20 to 40 days, between about 25 to 35 days or between about 30 and 35 days.

In some embodiments, the tobacco is secured within the moisture-retaining material for at least 4 days, at least 5 days, at least 6 days, at least 7 days, at least 8 days, at least 9 days, at least 10 days, at least 11 days, at least 12 days, at least 13 days, at least 14 days, at least 15 days, at least 16 days, at least 17 days, at least 18 days, at least 19 days, at least 20 days, at least 21 days, at least 22 days, at least 23 days, at least 24 days, at least 25 days, at least 26 days, at least 27 days, at least 28 days, at least 29 days, at least 30 days, at least 31 days, at least 32 days, at least 33 days, at least 34 days, at least 35 days, at least 36 days, at least 37 days, at least 38 days, at least 39 days, at least 40 days, at least 41 days, at least 42 days, at least 43 days, at least 44 days or at least 45 days.

In some embodiments, the tobacco is secured within the moisture-retaining material for up to 5 days, up to 6 days, up to 7 days, up to 8 days, up to 9 days, up to 10 days, up to 11 days, up to 12 days, up to 13 days, up to 14 days, up to 15 days, up to 16 days, up to 17 days, up to 18 days, up to 19 days, up to 20 days, up to 21 days, up to 22 days, up to 23 days, up to 24 days, up to 25 days, up to 26 days, up to 27 days, up to 28 days, up to 29 days, up to 30 days, up to 31 days, up to 32 days, up to 33 days, up to 34 days, up to 35 days, up to 36 days, up to 37 days, up to 38 days, up to 39 days, up to 40 days, up to 41 days, up to 42 days, up to 43 days, up to 44 days, up to 45 days, up to 46 days, up to 47 days, up to 48 days, up to 49 days, up to 50 days, up to 51 days, up to 52 days, up to 53 days, up to 54 days, up to 55 days, up to 56 days, up to 57 days, up to 58 days, up to 59 days, up to 60 days, up to 61 days, up to 62 days, up to 63 days, up to 64 days or up to 65 days.

Embodiments in which the tobacco material reaches a higher temperature may require a shorter process period than embodiments in which the tobacco material reaches a lower temperature. In some embodiments, the temperature reached by the tobacco material during the process is about 5° C. above the ambient processing temperature, or between about 2 and 5° C. above the ambient processing temperature and the process takes place over a total of 25 to 35 days or a total of 20 to 30 days. This may lead to transformation of the organoleptic properties of the tobacco material. In other embodiments, the temperature reached by the tobacco material during the process is between about 2 and 5° C. above the ambient processing temperature and the process takes place over a total of 5 to 16 days, a total of 6 to 15 days or a total of 8 to 12 days. This may lead to enhancement of the organoleptic properties of the tobacco material.

In some embodiments, the tobacco material is treated so that it is held at the threshold temperature for a relatively short period of time and the organoleptic properties are enhanced. In some embodiments, the process is halted about 6 hours, 12 hours, 18 hours, 24 hours, or 2, 3, 4, 5, 6, 7 or 8 days after the temperature of the tobacco material reaches a threshold temperature. In some embodiments, the threshold temperature is 55° C., 60° C., or 65° C. The period of time for which the tobacco material is maintained at or above the threshold temperature may influence the manner and extent to which the organoleptic properties of the tobacco material are enhanced by the process. The threshold temperature may differ for different types of tobacco. The period for which the tobacco is maintained at or above the threshold temperature may differ for different types of tobacco.

In other embodiments, the tobacco material is treated so that it is held at the threshold temperature for a longer period of time and the organoleptic properties are transformed. In some embodiments, the process is halted no less than 12 days after the temperature of the tobacco material reaches a threshold temperature. In some embodiments, the threshold temperature is 55° C., 60° C., or 65° C. The period of time for which the tobacco material is maintained at or above the threshold temperature may influence the manner and extent to which the organoleptic properties of the tobacco material are transformed by the process. The threshold temperature may differ for different types of tobacco. The period for which the tobacco is maintained at or above the threshold temperature may differ for different types of tobacco.

In other embodiments, the process involves treating the tobacco material until the temperature of the tobacco material reaches a target temperature, and then allowing the tobacco material to cool. This cooling may be effected by removing the tobacco material from the processing area which is being held at an elevated temperature. In some embodiments, the target temperature is 60° C., 61° C., 62° C., 63° C., 64° C., 65° C., 66° C., 67° C., 68° C., 69° C. or 70° C. In some embodiments, the target temperature is within the range of 62 to 67° C. The target temperature may differ for different types of tobacco.

It has been found that at least one change to the organoleptic properties of the tobacco material is a result of a reduction in the negative properties, for example as a result of a reduction in tobacco material components that have an unpleasant taste or have an irritant effect. Proline is an example of a component that is associated with such negative properties, as explained in more detail in Table 12 below. In some embodiments, the organoleptic properties are changed by an increase in the positive properties, for example as a result of the increase in or introduction of components that make a positive contribution to the organoleptic properties, such as components having pleasant flavours. Examples of components that are associated with such positive properties are provided in Table 11 below.

In some embodiments the tobacco material is treated so that it has desirable organoleptic properties that are produced in a reliable way and at relatively high volumes. In some embodiments, the process is a batch process.

In an embodiment, 180-200 kg of tobacco material with a moisture content of 12 to 14% is wrapped in Polyliner® material and placed in a C-48 carton. The C-48 carton is placed within a chamber that maintains the relative processing humidity at 60% and the processing temperature at 60° C. After a period of 5 to 9 days the temperature of the tobacco material reaches a temperature of about 60° C. and then continues to rise, to reach up a temperature of at least 5° C. above the ambient processing temperature after 7 to 13 days. The tobacco material is incubated for a total of 25 to 35 days.

After the tobacco has been incubated for the desired length of time, the treated tobacco may be cooled down while remaining in the moisture-retaining material.

The process parameters are sufficiently gentle for the treated tobacco material to maintain some or all of its physical properties. For example, the tobacco material remains sufficiently intact following treatment to allow handling and/or processing for incorporation into a tobacco-containing product, such as a smoking article. This enables the treated tobacco material to undergo handling in accordance with standard processes.

Figure 2:
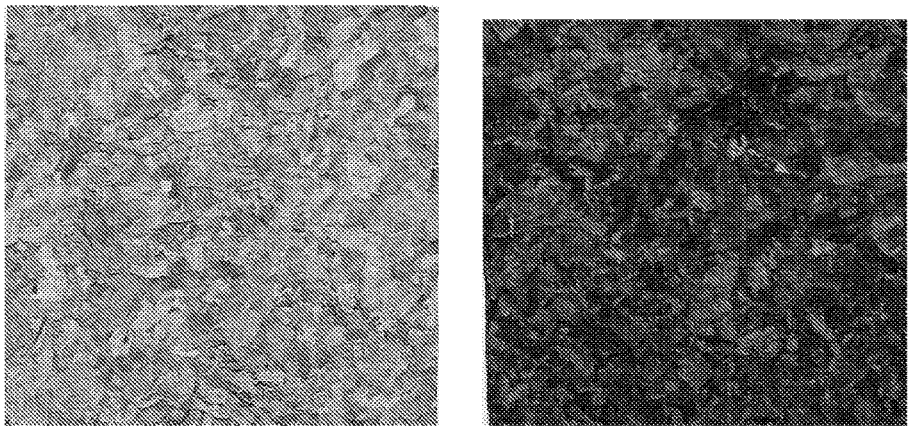
FIG. 2 is a close-up view of the tobacco shown in FIG. 1.

The treated tobacco material may have a different colour from untreated tobacco material. In some embodiments, the tobacco material is darker than untreated tobacco material. This can be seen in FIGS. 1 and 2, in which the untreated tobacco on the left of the Figures is lighter than the treated tobacco on the right of the Figures.

Importantly, in some embodiments the treated tobacco material has organoleptic properties that are acceptable and/or desirable for the consumer. Thus, tobacco material with desirable organoleptic properties can be produced by the treatment of tobacco under a specific set of conditions, and without requiring the addition of one or more further chemical(s), which may be hazardous and/or expensive. Moreover, the treated tobacco does not need to undergo an additional treatment step to remove the further chemical(s), which would add extra cost and time to the tobacco treatment process.

The organoleptic properties of the treated tobacco material may be developed when the tobacco material is secured within the moisture-retaining material, during which period the components in the tobacco material undergo chemical changes and modifications, to give desirable organoleptic characteristics to the final product. The treated tobacco material may, in some embodiments, have a sweet spicy and/or dark note. The treated tobacco material may not, in some embodiments, have a dry and/or bitter note.

In some embodiments the chemical composition of the treated tobacco material differs significantly from untreated tobacco material. As shown in the data set out in the Example, in some embodiments the majority of the sugars in the treated tobacco material are converted. In addition, in some embodiments the smoke generated out of the processed material incorporated into a smoking article such as a cigarette contains increased levels of pyrazine and alkylpyrazines. In some embodiments the treated tobacco material contains increased levels of 2,5 deoxyfructosazine and 2,6 deoxyfructosazine, compared with untreated tobacco material. The altered levels of these compounds contribute to the desirable taste and aroma of the treated tobacco material.

Without being bound by theory, it is thought that the change in the levels of at least some of these compounds is due at least in part to the Maillard reaction taking place during the process. A caramelisation reaction may also be taking place during the process, which may lead to reduced levels of reducing and non-reducing sugars.

In addition, in some embodiments a significant decrease in the content of various amino acids may be seen.

The treated tobacco material may, in some embodiments, contain a reduced level of nicotine compared with untreated tobacco material, as shown in the Example. Nicotine is known to have a bitter taste and therefore having reduced levels of this compound can have a positive effect on the taste and flavour of the treated tobacco material.

The production of a tobacco material with desirable organoleptic properties advantageously removes the requirement to add further substances to the tobacco to provide or enhance its organoleptic properties. Such substances include flavourants and/or aromatising ingredients.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The treated tobacco material may be incorporated into a smoking article. As used herein, the term 'smoking article' includes smokable products such as cigarettes, cigars and cigarillos whether based on tobacco, tobacco derivatives, expanded tobacco, reconstituted tobacco or tobacco substitutes and also heat-not-burn products.

The treated tobacco material may be used for roll-your-own tobacco and/or pipe tobacco.

The treated tobacco material may be incorporated into a smokeless tobacco product. 'Smokeless tobacco product' is used herein to denote any tobacco product which is not intended for combustion. This includes any smokeless tobacco product designed to be placed in the oral cavity of a user for a limited period of time, during which there is contact between the user's saliva and the product.

The treated tobacco material may be blended with one or more tobacco materials before being incorporated into a smoking article or smokeless tobacco product or used for roll-your-own or pipe tobacco.

In some embodiments, tobacco extracts may be created from tobacco material which has undergone the processing described herein. In some embodiments, the extract may be a liquid, for example it may be an aqueous extract. In other embodiments, the extract may be produced by supercritical fluid extraction.

In some embodiments, the extracts may be used in nicotine delivery systems such as inhalers, aerosol generation devices including e-cigarettes, lozenges and gum. For example, the tobacco extracts may be heated to create an inhalable vapour in an electronic cigarette or similar device. Alternatively, the extracts may be added to tobacco or another material for combustion in a smoking article or for heating in a heat-not-burn product.

In order to address various issues and advance the art, the entirety of this disclosure shows by way of illustration various embodiments in which the claimed invention(s) may be practiced and provide for superior tobacco treatment processes. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

EXAMPLE

The present invention is illustrated in greater detail by the following specific Example. It is to be understood that the Example is an illustrative embodiment and that this invention is not to be limited by the Example.

Treatment of Tobacco

Virginia tobacco was green-leaf blended and threshed, conditioned and packed in a C-48 box at 200 kg and 13% oven volatiles moisture (3 hours at 110° C.), wrapped with polyethylene liner (Polyliner®), and was set to rest for a minimum period of 30 days before being exposed to the ambient processing conditions of 60° C. and 60% relative humidity and a process time of 30 days.

Analysis of Nicotine

The nicotine content of the treated tobacco was analysed by a colorimetric method. The results of the analysis are provided in Table 1.

TABLE 1

Nicotine content of treated and untreated tobacco

| | % Nicotine, n = 30 | |
|---|---|---|
| | Before treatment | After treatment |
| Average | 3.33 | 3.11 |
| Maximum | 3.57 | 3.25 |
| Minimum | 3.14 | 2.87 |
| Stdev* | 0.10 | 0.09 |

*Stdev = standard deviation

It can be seen from Table 1 that the tobacco material contains a reduced amount of nicotine after treatment compared with before treatment.

Analysis of Sugars

The total sugar content of the treated tobacco was analysed by a colorimetric determination of all reducing substances plus sucrose. The results of the analysis are provided in Table 2.

TABLE 2

| Sugar content of treated and untreated tobacco | | |
|---|---|---|
| | % Sugar, n = 30 | |
| | Before treatment | After treatment |
| Average | 16.84 | 5.93 |
| Maximum | 18.51 | 7.24 |
| Minimum | 15.29 | 4.37 |
| Stdev* | 0.70 | 0.73 |

*Stdev = standard deviation

The results in Table 2 show that the tobacco contains a reduced amount of sugars after treatment compared with before treatment.

The total sugars content was measured by auto analyser by a colorimetric method and the results are provided in Tables 3 and 4. The results indicate a significant decrease in the content of various sugars.

TABLE 3

| Total sugars content before and after the treatment process | | | | |
|---|---|---|---|---|
| | Analyte | | | |
| | Total Sugars [%] | | Reduction [%] | |
| Sample | Control | Test | Relative | absolute |
| Batch 1; n = 30 | | | | |
| Average | 16.8 | 6.2 | 63.1 | 10.6 |
| Stdev | 0.67 | 0.52 | 0.82 | |
| Max | 18.1 | 7.2 | 12.5 | |
| Min | 15.3 | 4.9 | 8.7 | |
| Batch 2; n = 48 | | | | |
| Average | 16.7 | 6.3 | 62.2 | 10.4 |
| Stdev | 1.21 | 0.88 | 1.23 | |
| Max | 20.0 | 8.2 | 13.7 | |
| Min | 14.8 | 4.3 | 7.9 | |
| Batch 3; n = 26 | | | | |
| Average | 18.2 | 5.6 | 69.2 | 12.6 |
| Stdev | 0.55 | 0.38 | 0.67 | |
| Max | 19.5 | 8.3 | 14.1 | |
| Min | 17.1 | 4.5 | 9.7 | |

TABLE 3-continued

| Total sugars content before and after the treatment process | | | | |
|---|---|---|---|---|
| | Analyte | | | |
| | Total Sugars [%] | | Reduction [%] | |
| Sample | Control | Test | Relative | absolute |
| Batch 4; n = 48 | | | | |
| Average | 15.5 | 5.3 | 65.8 | 10.1 |
| Stdev | 0.62 | 0.76 | 0.85 | |
| Max | 16.7 | 6.4 | 12.8 | |
| Min | 14.1 | 3.3 | 8.5 | |
| Batch 1-4; n = 152 | | | | |
| Average | 16.6 | 5.8 | 65.1 | 10.8 |
| Stdev | 1.27 | 0.95 | 1.36 | |
| Max | 20.0 | 8.3 | 14.1 | |
| Min | 14.1 | 3.3 | 7.9 | |

TABLE 4

| Analysis of the total and individual sugars | | | | | | | | | |
|---|---|---|---|---|---|---|---|---|---|
| | Values in [%] | | | | | | | | |
| | Before Process | | | | After Process | | | | Red'n |
| (Count) | Ave. | Stdev | Max | Min | Ave. | Stdev | Max | Min | [%] |
| Total Sugars (20) | 17.96 | 0.50 | 18.9 | 17.2 | 6.46 | 0.73 | 7.3 | 4.8 | 64.0 |
| Fructose (10) | 5.80 | 0.17 | 6.1 | 5.58 | 1.75 | 0.40 | 2.25 | 1.02 | 69.7 |
| Glucose (10) | 4.88 | 0.25 | 5.36 | 4.61 | 0.82 | 0.10 | 0.96 | 0.68 | 83.1 |
| Sucrose (10) | 2.02 | 0.22 | 2.42 | 1.69 | 0.10 | 0.01 | 0.12 | 0.09 | 95.2 |
| Sum ind. Sugar | 12.70 | 0.45 | 13.5 | 12.17 | 2.67 | 0.50 | 3.32 | 1.78 | 79.0 |

To support the theory that sugars in the tobacco material are being reduced, the water content was analysed before and after processing. As the tobacco material was wrapped in water-retaining material there was no water being introduced into the tobacco material from the environment. Thus, it is believed that the increase in water/moisture observed post processing is generated by the reduction of the sugars in the tobacco material.

TABLE 5

| Analysis of water content (measured by Karl Fischer titration (KF)) and moisture (measured as Oven Volatiles (OV)) | | | | | | |
|---|---|---|---|---|---|---|
| | Water (KF) vs. Oven volatiles (OV) | | | | | |
| | Pre Process | | | Post Process | | |
| n = 28 | KF [%] | OV [%] | Δ [%] | KF [%] | OV [%] | Δ [%] |
| Average | 9.40 | 12.63 | 3.23 | 11.35 | 13.03 | 1.70 |
| Stdev | 0.26 | 0.26 | 0.19 | 0.36 | 0.34 | 0.23 |

TABLE 5-continued

| Analysis of water content (measured by Karl Fischer titration (KF)) and moisture (measured as Oven Volatiles (OV)) | | | | | | |
|---|---|---|---|---|---|---|
| | Water (KF) vs. Oven volatiles (OV) | | | | | |
| | Pre Process | | | Post Process | | |
| n = 28 | KF [%] | OV [%] | Δ [%] | KF [%] | OV [%] | Δ [%] |
| Min | 8.90 | 12.30 | 2.90 | 10.60 | 12.30 | 1.20 |
| Max | 10.20 | 13.30 | 3.60 | 11.90 | 13.80 | 2.20 |

Δ = difference

Analysis of Amino Acids

Analysis of the treated tobacco using ultrahigh pressure liquid chromatography (UPLC) with a Q-TOF (quadruple-time of flight) analyzer has indicated a significant decrease in the content of various amino acids, as indicated by the data shown in Table 6 below.

The ratio provided is the ratio between the content in the tobacco treated according to the present invention, compared to the control (untreated) tobacco. A ratio value <1 indicates that the treatment has resulted in a reduction in the component, whilst a ratio value >1 indicates an increase (and a ratio of 1 would mean that the content was unchanged). The data was derived from the average of ten samples before treatment and the average of ten samples after treatment.

TABLE 6

| Analysis of amino acid content | |
|---|---|
| Amino acids | Treatment/Control Ratio |
| Phenylalanine | 0.19 |
| Proline | 0.04 |
| L-N-(1H-Indol-3-ylacetyl)aspartic acid | 0.04 |
| Tryptophan | 0.03 |
| Histidine | 0.03 |
| Asparagine | 0.02 |

Analysis of Deoxyfructosazines and Other Products of the Maillard Reaction

The deoxyfructosazine content of the treated tobacco was analysed by high-performance liquid chromatography with UV detector (HPLC-UV). The results of the analysis are provided in Table 7. Tests 1 to 4 relate to tobacco material that is a range of different styles of the same type (Virginia). The tobacco material was treated in 200 kg batches in a C-48 box and 13% oven volatiles moisture (3 hours at 110° C.), wrapped with polyethylene liner (Polyliner®), and was set to rest for a minimum period of 30 days before being exposed to the ambient processing conditions of 60° C. and 60% relative humidity and a process time of 30 days.

TABLE 7

| Deoxyfructosazine content of treated (test) and untreated (control) tobacco | | | | |
|---|---|---|---|---|
| | Analyte | | | |
| | 2,5 Deoxyfructosazine | | 2,6 Deoxyfructosazine | |
| | Sample | | | |
| Unit | Control µg/g | Test µg/g | Control µg/g | Test µg/g |
| Test 1, n = 18 | | | | |
| Average | 54.9 | 324.1 | 54.5 | 283.4 |
| Stdev* | 11.1 | 100.0 | 8.9 | 55.2 |
| % Stdev | 20.3 | 30.9 | 16.3 | 19.5 |
| Test 2, n = 18 | | | | |
| Average | 56.3 | 526.8 | 50.4 | 391.9 |
| Stdev* | 12.1 | 172.1 | 10.4 | 117.6 |
| % Stdev | 21.4 | 32.7 | 20.7 | 30.0 |
| Test 3, n = 6 | | | | |
| Average | BLQ‡ | 307.8 | BLQ‡ | 273.7 |
| Stdev* | | 76.4 | | 46.0 |
| % Stdev | | 24.8 | | 16.8 |
| Test 4, n = 6 | | | | |
| Average | 86.2 | 256.8 | 118.5 | 225.2 |
| Stdev* | 9.0 | 37.2 | 8.9 | 33.2 |
| % Stdev | 10.5 | 14.5 | 7.5 | 14.8 |

*Stdev = standard deviation
‡BLQ = Below limit of quantification

The results show that the treated tobacco contains greatly increased levels of 2,5 deoxyfructosazine and 2,6 deoxyfructosazine compared with the untreated tobacco.

Analysis of the treated tobacco using ultrahigh pressure liquid chromatography (UPLC) with a Q-TOF (quadruple-time of flight) analyzer has indicated a significant increase in the content of various products of the Maillard Reaction, as indicated by the data shown in Table 8 below. The ratio provided in the table is the ratio between the content in the tobacco treated according to the present invention, compared to the control (untreated) tobacco.

TABLE 8

| Analysis of content of Maillard Reaction products | |
|---|---|
| Maillard reaction products | Treatment/ Control Ratio |
| 5-Acetyl-2,3-dihydro-1H-pyrrolizine | 22.06 |
| 2,3-Dihydro-5-methyl-1H-pyrrolizine-7-carboxaldehyde | 17.96 |
| 1,2,3,4,5,6-Hexahydro-5-(1-hydroxyethylidene)-7H-cyclopenta[b]pyridin-7-one | 12.22 |
| 1-(1-Pyrrolidinyl)-2-butanone | 10.73 |
| 1-(2,3-Dihydro-1H-pyrrolizin-5-yl)-1,4-pentanedione | 5.50 |
| 2,3,4,5,6,7-Hexahydrocyclopent[b]azepin-8(1H)-one | 5.26 |
| 5-(2-Furanyl)-1,2,3,4,5,6-hexahydro-7H-cyclopenta[b]pyridin-7-one | 4.05 |
| 4-(2-Furanylmethylene)-3,4-dihydro-2H-pyrrole | 3.82 |
| 1,2,3,4,5,6-Hexahydro-7H-cyclopenta[b]pyridin-7-one | 3.75 |
| 2,6-Deoxyfructosazine | 3.06 |
| 2,5-Deoxyfructosazine | 2.99 |

The increase in Maillard reaction products is surprising as the Maillard reaction was not thought to occur in tobacco at the temperature and moisture content to which the tobacco is being exposed during the processing according to the invention.

In light of the reduction in amino acids and sugars in the tobacco and the increase in Maillard reaction products, it would appear that the treatment process is providing conditions in which the Maillard reaction is enhanced in the tobacco. It is documented that many of the Maillard Reaction products have desirable sensory properties. For example, 5-acetyl-2,3-dihydro-1H-pyrrolizine and 2,3-dihydro-5-methyl-1H-pyrrolizine-7-carboxaldehyde both provide a caramel taste, whilst 2,3-dihydro-5-methyl-1H-pyrrolizine-7-carboxaldehyde, 5-(2-furanyl)-1,2,3,4,5,6-hexahydro-7H-cyclopenta[b]pyridin-7-one and 1,2,3,4,5,6-hexahydro-7H-cyclopenta[b]pyridin-7-one all have a peanut and roasted flavour. Thus, the products of the Maillard reaction are considered to play a part in the transformation of the organoleptic properties of the tobacco material, changing the overall taste and/or sensory characteristics.

Analysis of Lipids

The content of selected lipids of the treated and untreated tobaccos was compared using ultrahigh pressure liquid chromatography (UPLC) with a Q-TOF (quadruple-time of flight) analyzer and the results are shown in Table 9 below. The ratio provided in the table is the ratio between the content in the tobacco treated according to the present invention, compared to the control (untreated) tobacco.

TABLE 9

Analysis of lipid content

| Lipids | Treatment/Control Ratio |
|---|---|
| Oleic acid | 2.18 |
| Linoleic acid | 2.08 |
| Linolenic acid | 1.74 |

The data indicates that the treatment of the invention resulted in a significant increase in the content of the selected fatty acids. These fatty acids are believed to have a smoothening effect on the organoleptic properties of the tobacco material, suggesting that the increase in their content represents a further way in which the organoleptic properties of the treated tobacco material are improved, leading to the observed enhancement or refinement of the organoleptic properties.

Analysis of Pyrazines

The pyrazine and alkylpyrazine content of the smoke produced on combustion of the treated tobacco was analysed by headspace gas chromatography/mass spectrometry (HS-GC-GC-MS). The results of the analysis are provided in Table 10.

TABLE 10

Pyrazine and alkylpyrazine content of treated (sample) and untreated (reference) tobacco; area normalised to internal standard Quinoline-D7

| | Area normalised | |
|---|---|---|
| Compound† | Sample | Reference |
| Pyrazine | 0.16 | 0.02 |
| 2-Methylpyrazine | 0.93 | 0.73 |
| 2,5-dimethylpyrazine | 0.38 | 0.29 |
| 2,6-dimethylpyrazine | 0.13 | 0.09 |
| 2-ethylpyrazine | 0.26 | 0.13 |
| 2,3-dimethylpyrazine | 0.25 | 0.16 |
| 2-Ethyl-6-methylpyrazine | 0.40 | 0.27 |

TABLE 10-continued

Pyrazine and alkylpyrazine content of treated (sample) and untreated (reference) tobacco; area normalised to internal standard Quinoline-D7

| | Area normalised | |
|---|---|---|
| Compound† | Sample | Reference |
| 2,3,5-Trimethylpyrazine | 0.10 | 0.07 |
| 2-Ethyl-3-methylpyrazine | 0.08 | ND‡ |
| Tetramethylpyrazine | 0.05 | 0.04 |
| Quinoline-D7 | 1 | 1 |

†Compounds are presented in order of elution on the DB-FFAP column

‡ND = not detected

The results show that the smoke produced from combustion of the treated tobacco contains increased levels of pyrazine and alkylpyrazines compared with the untreated tobacco. Pyrazine and alkylpyrazines are believed to have a positive effect on the organoleptic properties of the tobacco material, suggesting that the increase in their content represents a further way in which the organoleptic properties of the treated tobacco material are improved.

Sensory Evaluation

The organoleptic and sensory properties of smoke produced by combustion of the treated tobacco were assessed by olfactometry. Human subjects assessed the smoke in laboratory settings to quantify and qualify the sensorial relevance of the treatment processes of the invention.

An extract was formed from smoke generated from the combustion of the treated tobacco. Individual smoke constituents were then isolated and assessed by an expert. This allowed individual compounds to be assigned an aroma profile. This data confirmed that the tobacco treatment had the effect of increasing compounds with a positive or beneficial effect of the organoleptic properties of the smoke, and/or reducing compounds with a negative or detrimental effect. The results of this sensory analysis complemented the chemical characterisation study of the treated tobacco and of smoke generated by its combustion.

In addition, the sensory evaluation of the smoke as a whole confirmed that whilst the untreated bright Virginia tobacco had the usual taste, the treated tobacco had acquired a sweet, spicy and dark note, giving more roundness with an increased balance and mouth full without increasing impact. What is more, the flavour of the treated tobacco was not accompanied by the dry and bitter notes that are normally associated with dark tobaccos. The treated tobacco also had a sweet, mellow aftertaste.

In the tables below there are some examples of constituents of the tobacco material and of the smoke created by combustion of the tobacco material which have positive and negative impacts on the sensory attributes of the smoke, i.e. the organoleptic properties. These constituents are believed to be involved in the enhancement of the organoleptic properties of the tobacco material as a result of the processing described herein.

TABLE 11

Sensorial attributes of smoke constituents

| Smoke Constituent identified by GC-MS | Treatment/ Control Ratio | Sensorial attributes: Smoke Taste | Sensorial attributes: Smoke Aroma |
|---|---|---|---|
| Palmitic acid, methyl ester | 15 | smoothing | smoothing |
| 9,12-Octadecadienoic acid, methyl ester | 15 | smoothing, sweet | sweet |
| 9,12,15-Octadecatrienoic acid, methyl ester | 15 | sweet, adds body | adds body |

TABLE 12

Sensorial attributes of blend constituents

| Blend Constituent identified by GC-MS | Treatment/ Control Ratio | Sensorial attributes: Smoke Taste | Sensorial attributes: Smoke Aroma |
|---|---|---|---|
| Proline | 0.04 | bitter, harsh | protein, burnt hair |

Analysis of Microbial Content

The microbial analysis of the treated tobacco was conducted by using Petrifilm® Yeast and Mould Count Plates for moulds and yeasts, Petrifilm® Aerobic Count Plates for total bacteria, and the most probable number (MPN) method for coliforms. The results of the analysis are provided in Table 13.

The results show that the microbial content of the treated tobacco is very low, with no coliform CFUs observed in the treated tobacco after incubation at 35° C. or 45° C., and very low numbers of CFUs observed for moulds and yeasts and in the aerobic plate count.

TABLE 13

Microbial analysis of tobacco before and after treatment

| | Time | Aerobic Plate Count (CFU/g) | Moulds (CFU/g) | Yeasts (CFU/g) | Coliforms 35° C. (CFU/g) | Coliforms 45° C. (CFU/g) |
|---|---|---|---|---|---|---|
| Sample 1 | Before process | 1.80E+05 | 1.23E+03 | 3.33E+01 | 4.83E+02 | non observed |
| Sample 2 | Before process | 1.80E+05 | 9.33E+02 | 3.33E+01 | 6.40E+02 | non observed |
| Sample 1 | After process (14 days) | <10* | <10* | <10* | non observed | non observed |
| Sample 2 | After process (14 days) | 2.00E+01 | <10* | <10* | non observed | non observed |
| Sample 1 | After process (42 days) | 6.66E+00 | <10* | <10* | non observed | non observed |
| Sample 2 | After process (42 days) | 6.66E+00 | <10* | <10* | non observed | non observed |

*<10 = below detection limit

This data confirms that the processing of the tobacco material as described herein does not involve fermentation.

The invention claimed is:

1. A process for treating tobacco material comprising securing tobacco material within a moisture-retaining material and exposing the tobacco material to an ambient processing temperature of between 55° C. and about 120° C., wherein the tobacco material has a packing density on a dry matter weight base of between 200 kg/m$^3$ and about 500 kg/m$^3$ at the start of the treatment process and has a moisture content of between about 10% and 23% before and during the treatment process, wherein the microbial content of the treated tobacco material is lower than the microbial content of the untreated tobacco material, and wherein the treatment process does not substantially ferment the tobacco material.

2. The process according to claim 1, wherein the tobacco material has a moisture content of between about 10% and 15.5% before and during treatment.

3. The process according to claim 1, wherein the tobacco material has a moisture content of between about 10% and 18% before and during the treatment.

4. The process according to claim 1, wherein the tobacco material is secured within the moisture-retaining material for between about 5 and 65 days.

5. The process according to claim 1, wherein the temperature of the tobacco material reaches the ambient processing temperature within about 4 to 10 days.

6. The process according to claim 1, wherein the temperature of the tobacco material reaches a second temperature that is higher than the ambient processing temperature and is up to about 150° C.

7. The process according to claim 6, wherein the second temperature is at least 2° C. above the ambient processing temperature and is up to about 150° C.

8. The process according to claim 6, wherein the second temperature is reached within about 7 to 13 days.

9. The process according to claim 1, wherein the tobacco material is post-curing tobacco.

10. The process according to claim 1, wherein there is a reduction in the content of at least one of the compounds selected from the group consisting of: nicotine, reducing sugars, non-reducing sugars and amino acids in the treated tobacco material.

11. The process according to claim 1, wherein there is an increase in the content of at least one of the products of the Maillard Reaction in the treated tobacco material.

12. The process according to claim 10, wherein the products of the Maillard Reaction are one or more of the products selected from the group consisting of: 2,6-deoxyfructosazine; 2,5-deoxyfructosazine; 5-acetyl-2,3-dihydro- 1H-pyrrolizine; 2,3-dihydro-5-methyl-1H-pyrrolizine-7-carboxaldehyde; 1,2,3,4,5,6-hexahydro-5-(1-hydroxyethylidene)-7H-cyclopenta[b]pyridin-7-one; 1-(1-pyrrolidinyl)-2-butanone; 1-(2,3-dihydro-1H-pyrrolizin-5-yl)-1,4-pentanedione; 2,3,4,5,6,7-hexahydro-cyclopent[b]azepin-8(1H)-one; 5-(2-furanyl)-1,2,3,4,5,6-hexahydro-7H-cyclopenta[b]pyridin-7-one; 4-(2-furanylmethylene)-3,4-dihydro-2H-pyrrole; and 1,2,3,4,5,6-hexahydro-7H-cyclopenta[b]pyridin-7-one.

13. The process according to claim 1, wherein the ambient processing humidity is between about 50-500 g water/$m^3$ for ambient processing temperatures around or above 100° C., about 50-340 g water/$m^3$ for ambient processing temperatures around 90° C., about 50-230 g water/$m^3$ for ambient processing temperatures around 80° C., about 50-160 g water/$m^3$ for ambient processing temperatures around 70° C., about 50-110 g water/$m^3$ for ambient processing temperatures around 60° C. or about 40-80 g water/$m^3$ for ambient processing temperatures around 55° C.

14. The process according to claim 1, wherein the moisture-retaining material is wrapped around the tobacco material.

15. The process according to claim 14, wherein the moisture-retaining material comprises flexible polymeric material.

16. The process according claim 15, wherein the flexible polymeric material comprises polyethylene.

17. The process according to claim 1, wherein the tobacco material secured within the moisture-retaining material is placed in a chamber to control the ambient processing temperature and/or ambient relative processing humidity.

18. The process according to claim 1, wherein the tobacco material comprises whole leaf tobacco.

19. The process according to claim 1, wherein the tobacco material does not comprise cut rag tobacco.

20. The process according to claim 1, wherein the moisture content of the tobacco material at the end of the process is higher than the moisture content of the tobacco material at the start of the process, wherein a sugar content of the tobacco material at the end of the process is lower than a sugar content of the tobacco material at the start of the process, and/or wherein the tobacco material at the end of the process is further processed for incorporation into a smoking article.

21. The process according to claim 1, wherein the sugar content of the tobacco material at the end of the process is lower than the sugar content of the tobacco material at the start of the process.

22. The process according to claim 1, wherein the tobacco material at the end of the process is further processed for incorporation into a smoking article.

23. The process according to claim 1, wherein the tobacco material at the end of the process is suitable for incorporation into a smoking article.

* * * * *